United States Patent [19]

Yamasaki et al.

[11] Patent Number: 4,559,200

[45] Date of Patent: Dec. 17, 1985

[54] HIGH STRENGTH AND HIGH CONDUCTIVITY COPPER ALLOY

[75] Inventors: Syuichi Yamasaki, Saitama; Hiroshi Yamaguchi, Tokyo; Yousuke Taniguchi, Saitama, all of Japan

[73] Assignee: Mitsui Mining and Smelting Company, Ltd., Tokyo, Japan

[21] Appl. No.: 638,566

[22] Filed: Aug. 7, 1984

[30] Foreign Application Priority Data

Aug. 12, 1983 [JP] Japan ..... 58-146635

[51] Int. Cl.[4] ..... C22C 9/00

[52] U.S. Cl. ..... 420/492; 420/473; 420/484; 420/487; 420/489; 420/494; 420/495; 420/496; 420/499

[58] Field of Search ..... 420/492, 488, 496, 473, 420/472, 484, 487, 489, 494, 495, 499; 148/11.5 C, 12.7 C, 411–414, 432–436, 160

[56] References Cited

FOREIGN PATENT DOCUMENTS 63651 11/1980 Fed. Rep. of Germany ..... 420/492

79848 6/1980 Japan ..... 148/12.7 C

*Primary Examiner*—Peter K. Skiff

*Attorney, Agent, or Firm*—Kane, Dalsimer, Kane, Sullivan and Kurucz

[57] ABSTRACT

A copper alloy excellent in general properties such as heat resistance, electric and heat conductivity and mechanical strength and suitable for use as materials for lead frames of electronic parts, heat exchanger fins, or the like can be obtained by optimizing the Fe and Ti contents and proportions of a Cu-Fe-Ti ternary alloy and adding thereto a suitable amount of one or more members selected from the group consisting of Mg, Sb, V Misch metal, Zr, In, Zn, Sn, Ni, Al, and P.

3 Claims, 10 Drawing Figures

HIGH STRENGTH AND HIGH CONDUCTIVITY COPPER ALLOY

BACKGROUND OF THE INVENTION

This invention relates to a copper alloy which is suitable as a material which must have general properties such as heat resistance, electric and heat conductivity, solderability, workability and mechanical strength, including a material for semiconductor lead frames, a material for electronic and electrical parts such as connector switches, or a material for heat exchanger fins.

As a lead frame material for electronic devices such as semiconductors, IC, and LSI, 42-alloy (Fe-42% Ni alloy) having good sealability for a ceramic package has heretofore been used generally. As resin packaging becomes widespread recently and its cost is reduced, the use of lead frame materials of a copper alloy has been increased rapidly, and CDA 194 alloy and phosphor bronze are chiefly used. Recently, with the progress of large IC integration, a demand has grown for high-strength, highly heat-resistant copper alloys. The above-mentioned CDA 194 alloy, however, has a somewhat lower softening temperature though it has good strength and conductivity (heat conductivity can be roughly estimated from electric conductivity), whereas phosphor bronze has a lower conductivity though it has excellent strength and flexibility. Thus, they have both merits and demerits.

The properties which a material for lead frames must generally have are as follows:

(1) A lead frame material has excellent electric and heat conductivity corresponding to the degree of integration of a semiconductor.

(2) A lead frame material can withstand high temperatures during die bonding and is resistant to softening.

(3) Its lead portion can withstand bending and has an excellent strength sufficient to resist twisting and bending by a stress exerted on the lead portion when its thickness is reduced.

(4) A lead frame material has good solderability.

(5) A lead frame material has good oxidation resistance at high temperatures.

(6) A lead frame material undergoes no hydrogen embrittlement.

On the other hand, with regard to copper alloys for use in electrical parts such as connector switches, heretofore known excellence in their properties such as conductivity, stress corrosion cracking resistance, and corrosion resistance will not suffice, and it is desirable in reducing the cost by thinning the parts that the copper alloys have sufficient strength and excellent heat resistance during brazing.

Also the properties of Sn-containing copper (Cu-0.2% Sn) which has heretofore been used as main material for heat exchanger fins cannot cope with the tendency of the reduction in the thickness of a material. Therefore, there has been a demand for copper alloys which have excellent mechanical strength and softening resistance as well as sufficient conductivity.

Announced copper alloys having improved mechanical strength and conductivity include a Cu-Fe-Ti-Ni quaternary alloy having a composition of 1.4% of Fe, 1.0% of Ti, 1.5% of Ni, and the balance of Cu (Japanese Patent Publication No. 1253/1959) and a Cu-Fe-Mg-P quaternary alloy (U.S. Pat. No. 4,305,762). According to the confirmative study by the inventors of this invention, however, they can not be said to be fully satisfactory in respect of the properties which are required of, for example, a material for lead frames, especially electric conductivity and mechanical strength.

In view of these facts, this invention has been made for the purpose of facilitating the industrial production of a Cu-Fe-Ti ternary alloy excellent in strength, electric and heat conductivity and heat resistance and of improving its properties by adding additives.

SUMMARY OF THE INVENTION

It is an object of this invention to provide a copper alloy which has more excellent electric and heat conductivity and mechanical strength than the conventional Cu-Fe-Ti alloys.

It is another object of this invention to provide a copper alloy excellent in general properties such as heat resistance, electric and heat conductivity, solderability, platability, and mechanical strength and therefore suitable for use as a material for semiconductor lead frames, electrical and electronic parts such as connector switches, or a material for heat exchanger fins.

According to this invention, a high strength, heat resistant copper alloy is provided which comprises 0.05 to 1.0% by weight of Ti, 0.07 to 2.6% by weight of Fe, and one or more members selected from the group consisting of 0.005 to 0.5% by weight of Mg, 0.01 to 0.5% by weight of each of Sb, V, Misch metal, Zr, In, Zn, Sn, and Ni, 0.05 to 0.2% by weight of Al, and 0.005 to 0.07% by weight of P, and the balance of Cu.

DETAILED DESCRIPTION OF THE INVENTION

The necessity of addition of each component of the alloy of this invention and limitation of the amount of addition will now be described.

Figure 1:
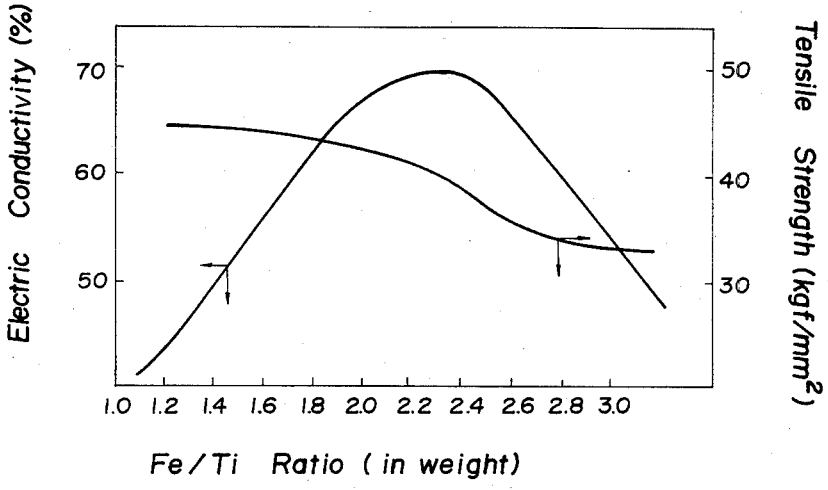
FIG. 1 is a graph which shows the relationship between the Fe/Ti ratio and the conductivity or tensile strength of a Cu-Fe-Ti alloy (Ti: 0.35 wt. %).

Ti and Fe can improve the properties which are aimed at in this invention (heat resistance, electric conductivity, and strength) by their co-existence effect. Namely, Ti imparts strength and good softening resistance to the alloy of this invention, and when it is used in conjunction with Fe, the conductivity is improved markedly and so are the strength and heat resistance. This is probably because a compound of Ti and Fe is formed when finely precipitated by aging. When the Ti content is below 0.05% (% by weight, the same applies hereinafter), its effect of improving the strength and heat resistance is small even if it is used in conjunction with Fe, and when Ti is added in an amount exceeding 1%, the heat resistance and conductivity are lowered and the solderability becomes poor. Further, the flowability of a molten metal in the melting/casting process becomes poor and the formation of an oxide film becomes so marked that it is difficult to carry out melting in air. On the other hand, when the content of Fe which in coexistence with Ti can exhibit an effect of improving the properties of the alloy is below 0.07%, its effect is small, while when it exceeds 2.6%, the effect is saturated. Because the excellent properites of the alloy of this invention results essentially from the deposition of a compound of Fe and Ti, a proper ratio of Fe to Ti exists and the ratio by weight (Fe/Ti) is 1.4 to 2.6, preferably 1.7 to 2.3. With regard to this ratio, the inventors of this invention have studies using a Cu-Fe-Ti ternary system, and obtained knowledge about the relationships between the Fe/Ti ratio and the conductivity or strength represented by the results shown in FIG. 1. When the Fe/Ti ratio is below 1.4, excess Ti dissolves in a matrix and lowers the conductivity, while when it exceeds 2.6, excess Fe dissolves in a matrix to cause a marked decrease especially in the tensile strength as well as decrease in the conductivity. This tendency is also true of alloys which are formed by further adding the other elements of this invention.

The role of the elements other than Fe and Ti which is a feature of the alloy of this invention will be described. It has been found that, although the Cu-Fe-Ti ternary alloy suffers marked lowering in the strength, electric conductivity, and softening temperature when the solution treatment temperature is lower (below 750° C.) as compared with the case where it is subjected to a solution treatment at a high temperature (850° C.) and water-quenched (see FIG. 2), the addition of Mg, Sb, V, Misch metal, Zr, In, Sn, or Ni is effective in preventing one or more of these properties from being lowered. This means that an intentional solution/quenching treatment is not always necessary industrially, and a substantial solution/quenching treatment can be effected by water quenching after hot rolling or quenching after continuous annealing carried out in an intermediate step of cold rolling.

Namely, the addition of Mg is effective in improving the strength and heat resistance and, in this case, the electric conductivity can be somewhat improved when the amount of the Mg added is small but is somewhat lowered as compared with the case of no addition when the amount of the Mg used is large. The effect of the addition of Mg on the strength and electric conductivity is apparent from the graph of FIG. 3 described in Example 3, which shows a curve of the tensile strength after annealing at 500° C., that is, an alloy of this kind has a softening temperature of as high as above 500° C.

The effect of the addition of Mg is not sufficient when its content is below 0.005%, while when it exceeds 0.5%, the effect of improving the tensile strength and softening resistance substantially disappears, the electric conductivity is lowered markedly, and the workability is also lowered.

In order to improve the mechanical strength and electric conductivity with good balance, the amount of the Mg added is preferably 0.03 to 0.10%. Elements which have the same effect of addition as that of Mg include Zr, Sn, and Zn.

As compared with the addition of Mg, the addition of Ni is less effective in improving the tensile strength and heat resistance but is more effective in improving the electric conductivity. The effect of Ni on the tensile strength and conductivity is clearly shown in the graph of FIG. 4 in Example 4, that is, when the amount of the Ni added is below 0.005%, its effect is small, while when it exceeds 0.5%, the effect of improving the tensile strength is saturated and the conductivity is lowered markedly. In order to improve the mechanical strength and electric conductivity with good balance, it is preferred that the amount of the Ni added is in the range of 0.01 to 0.07%. An element which exerts the same effect as that of Ni includes In.

Although the addition of Sb, Misch metal, or V causes lowering of the heat resistance of the resulting alloy as compared with the case of no addition, the alloy shows excellent properties in respect of electric conductivity probably because the state of deposition of precipitates is changed. When the amount of the Sb, Misch metal, or V added is below 0.01%, no effect of improving the electric conductivity can be obtained, while when it exceeds 0.5%, the electric conductivity is rather lowered and besides the workability is lowered markedly.

Al is effective in reducing the consumption of Ti in the melting/casting step of the alloy of this invention and improving its yield of addition. When its amount is below 0.005%, no effect of its addition can be obtained, while when it exceeds 0.2%, the softening resistance and electric conductivity are adversely affected.

P may be added as a predeoxidizer and is effective in improving the yield of addition of Ti. Further, when P is added together with, for example, Mg, a Mg-P compound is deposited in addition to the Fe-Ti compound, so that it is possible to improve the properties. When P is added as a predeoxidizer or a yield-improving agent, the amount of P remaining in the alloy may be small (0.005%), but when it is used as a constituent element of the precipitate, an amount of 0.01 to 0.07% is suitable. Namely, an amount of P smaller than 0.01% is not sufficient to form a precipitate, so that no effect of improving the tensile strength and heat resistance can be obtained. On the other hand, when this amount exceeds 0.07%, the amount of P which dissolves in a matrix increases, with a consequent marked decrease in the electric conductivity.

Further, a third component including Mg and Ni can play their roles additively, or exhibit synergistically their effects by using a combination of at least two of the members, each within the limit of a proper amount.

Examples of this invention will now be described.

EXAMPLE 1

Electrolytic copper was melted in an alumina crucible by using a high-frequency induction melting furnace, while the surface of the molten metal was covered with charcoal powder. To this were added electrolytic iron, Cu-25% Ti alloy, Cu-50% Mg alloy, In, Ni, Misch metal, V, Sb, Zr, Sn, Zn, Al, or P, and the mixtures were cast into metal molds to obtain ingots measuring $25^t \times 85^w \times 150^l$. The compositions of these alloys and comparative alloys are shown in Table 1. Comparative alloy No. 18 was characterized in that it contained no Ti as was different from the alloy of this invention and intended for an alloy having the same composition as that of CDA 194 alloy, which could be compared with the conventional alloys used in lead frames or electrical parts. Both of the surfaces were milled (to a depth of 2 mm), and hot rolled at 750° C. to a thickness of 3 mm, further subjected to a solution treatment at 750° C. for 2 hours, and cold-rolled into a 0.8 mm-thick sheet. Pieces for a tensile test and for measurement of electric conductivity were cut from this sheet, and annealed at various temperatures for one hour. The properties shown in Table 1 include comparison of the tensile strengths and elongations and electric conductivities after annealing at 500° C. for one hour.

TABLE 1

| | Chemical composition (wt. %) | | | | Before Annealing | |
|---|---|---|---|---|---|---|
| No. | Ti | Fe | Mg, Ni, In, Zr, Sn, Zn, Misch metal, Sb, V, Al, P | Cu | Tensile strength kgf/mm² | Elongation % |
| | Alloys of this invention | | | | | |
| 1 | 0.35 | 0.65 | Mg 0.03 | balance | 49.5 | 3 |
| 2 | 0.86 | 1.58 | Mg 0.39 | " | 59.7 | 4 |
| 3 | 0.09 | 0.20 | Mg 0.03 | " | 43.0 | 3 |
| 4 | 0.33 | 0.64 | Ni 0.04 | " | 48.1 | 3 |
| 5 | 0.38 | 0.69 | Ni 0.06, Al 0.03 | " | 54.0 | 4 |
| 6 | 0.37 | 0.67 | In 0.07 | " | 49.9 | 3 |
| 7 | 0.39 | 0.70 | Zr 0.08 | " | 50.5 | 4 |
| 8 | 0.34 | 0.64 | Sn 0.28 | " | 49.2 | 3 |
| 9 | 0.41 | 0.78 | Zn 0.08 | " | 49.7 | 3 |
| 10 | 0.32 | 0.68 | Misch metal 0.06 | " | 46.7 | 4 |
| 11 | 0.32 | 0.67 | Sb 0.07 | " | 50.6 | 2 |
| 12 | 0.34 | 0.70 | V 0.07 | " | 47.6 | 2 |
| 13 | 0.36 | 0.69 | Mg 0.09, P 0.03 | " | 50.3 | 4 |
| | Comparative alloys | | | | | |
| 14 | 0.36 | 0.64 | — | " | 48.9 | 2 |
| 15 | 0.64 | 1.36 | — | " | 53.6 | 4 |
| 16 | 0.34 | — | — | " | 41.3 | 3 |
| 17 | 1.10 | 2.00 | Mg 0.25 | " | 58.5 | 3 |
| 18 | — | 2.4 | Zn 0.2, P 0.04 | " | 50.0 | 4 |

| | After annealing | | |
|---|---|---|---|
| No. | Tensile strength kgf/mm² | Elongation % | Electric conductivity % IACS |
| | Alloys of this invention | | |
| 1 | 47.0 | 12 | 61.6 |
| 2 | 48.5 | 15 | 52.0 |
| 3 | 39.0 | 19 | 73.0 |
| 4 | 45.7 | 14 | 65.9 |
| 5 | 40.5 | 21 | 60.8 |
| 6 | 44.2 | 14 | 58.0 |
| 7 | 48.0 | 11 | 52.3 |
| 8 | 45.4 | 18 | 56.4 |
| 9 | 45.7 | 12 | 56.0 |
| 10 | 34.3 | 34 | 74.9 |
| 11 | 36.1 | 28 | 76.2 |
| 12 | 38.6 | 24 | 68.5 |
| 13 | 48.7 | 12 | 56.7 |
| | Comparative alloys | | |
| 14 | 43.0 | 19 | 59.9 |
| 15 | 43.4 | 24 | 50.0 |
| 16 | 36.3 | 18 | 38.8 |
| 17 | 46.9 | 18 | 45.2 |
| 18 | 31.3 | 27 | 60.6 |

Table 1 shows that, as compared with the comparative alloys, the alloys of this invention were excellent in one or more of the items of properties: heat resistance (small loss in tensile strength after annealing), tensile strength, and electric conductivity. With respect to melting and casting of alloy, the casitng of alloys Nos. 2 and 15, each of which had a high Ti content, was somewhat difficult because inclusion of oxides occurred easily during casting. In alloy No. 17, which had a specially high Ti content, this tendency was so marked that it was nearly impossible to obtain a normal ingot by smelting in air. Since alloy No. 5 contained Al, it showed a yield of as high as about 85%, whereas the other alloys of this invention had Ti yields of 70 to 80%. Although alloys Nos. 10, 11, and 12, containing Misch metal, Sb, or V, showed low tensile strengths at 500° C. annealing, but they showed at 450° C. annealing remarkably high tensile strength of 39.5, 41.4, and 44.9 kg.f/mm², respectively, so that they had softening temperatures of higher than 450° C.

When a copper alloy is used in electronic or electrical parts such as lead frames, the bending property of the material is also important. Alloys Nos. 1, 4, and 11, which had typical compositions of this invention, and comparative alloy No. 18 were subjected to a 90° double bending test. Namely, a 0.8 mm-thick rolled sheet was annealed at 500° C. for one hour, rolled to a thickness of 0.4 mm, annealed at 450° C. for one hour, and then formed into a 25%-cold-rolled sheet of a thickness of 0.3 mm. Test pieces each measuring 10 mm in width and 60 mm in length were cut from this sheet, and bent at an angle of 90° and bending radii of 0, 0.2 and 0.4 mm. Then, the bent portions were examined with a magnifying lens. The results are shown in Table 2.

TABLE 2

| | | Bending radii (mm) | | |
|---|---|---|---|---|
| No. | Alloy | 0 | 0.2 | 0.4 |
| 1 | alloy of this invention | | | |
| 4 | alloy of this invention | | | |
| 11 | alloy of this invention | | | |
| 18 | comparative alloy | | | |

small wrinkle
good

The alloys of this invention and the comparative alloy both showed slight roughening at R of O, but were good at R of 0.2 or larger, so that neither of them had any practical problem.

Further, alloys Nos. 1, 4 and 11, having typical compositions of this invention, and comparative alloy No. 20 were evaluated with regard to solderability, oxidation resistance, and hydrogen embrittlement by using test pieces cut from sheets prepared by annealing the same 0.8 mm-thick rolled sheet as mentioned above at 500° C. for one hour and further subjecting it to 20% cold rolling. The stress corrosion cracking resistance and corrosion resistance (salt spray test) were evaluated on test pieces produced by annealing 0.8 mm-thick rolled sheets at 500° C. for one hour, and subjecting them to 50% cold rolling.

The solderability was examined by immersing a test piece measuring 30 mm in width and 40 mm in length in a soldering bath (Sn 60-Pb 40) at 230° C. for 5 seconds and observing the state of solder deposition. Like the comparative alloy, the alloys of this invention had no problem. After strike electro palting, this sample was further electro plated to form a 3 μm-thick Ag plating, but no abnormality was noticed. This plated material was further heated at 450° C. for 5 minutes, but the samples had no problem like the comparative alloy.

The oxidation resistance was determined as follows. A test piece measuring 30 mm in width and 50 mm in length was heated in air (350° C.×2 hours, and 500° C.×5 hours) and washed with dilute sulfuric acid to remove the oxide film, and then a difference between the weights before and after the heating was determined per unit area. The results are shown in Table 3.

TABLE 3

| | | Oxidation loss | |
|---|---|---|---|
| No. | Alloy | 350° × 2 hr | 500° × 5 min |
| 1 | alloy of this | 37 mg/dm² | 145 mg/dm² |

TABLE 3-continued

| No. | Alloy | Oxidation loss 350° × 2 hr | Oxidation loss 500° × 5 min |
|---|---|---|---|
| | invention | | |
| 4 | alloy of this invention | 39 | 160 |
| 11 | alloy of this invention | 39 | 165 |
| 14 | comparative alloy | 39 | 166 |
| 18 | " | 65 | 187 |

The alloys of this invention were excellent as they were oxidized to a smaller depth than the comparative alloy because strong films of Ti oxide were formed on their surfaces when heated.

The hydrogen embrittlement test was made according to JIS, and performed by heating the surface of a sample at 850° C. for 30 minutes in a stream of hydrogen and then subjecting the sample to both a microscopic examination and a 180° tight bending test. The alloys Nos. 1, 4 and 11 of this invention and comparative alloy 18 showed no trouble.

The stress corrosion cracking resistance was examined according to the Thompson method. Alloys Nos. 1, 4, and 11, which were the typical alloys of this invention, and comparative alloy No. 18 underwent no embrittlement due to stress corrosion even after the lapse of 500 hours.

Alloys Nos. 1, 2 and 4 of this invention and comparative alloys Nos. 14 and 18 were subjected to a salt water spray test for 7 days. Their corrosion losses per unit area are shown in Table 4.

TABLE 4

| No. | Alloy | Corrosion loss, mg/dm$^2$ |
|---|---|---|
| 1 | alloy of this invention | 1.00 |
| 2 | alloy of this invention | 0.95 |
| 4 | alloy of this invention | 0.96 |
| 14 | comparative alloy | 1.31 |
| 18 | " | 1.09 |

Table 4 shows that the alloys of this invention are excellent in corrosion resistance.

EXAMPLE 2

A Cu-0.40 Ti-0.93 Fe-0.079 Mg-0.018 P alloy (an alloy of this invention) and a Cu-0.36 Ti-0.66 Fe alloy (comparative alloy) were cast in the same manner as in Example 1 and, after milling the castings were hot-rolled at 900° C. to a thickness of 3 mm. Then, the rolled sheets were subjected to a solution treatment at 700°, 850° or 1000° C. for one hour and, after water quenching, cold-rolled to a thickness of 0.8 mm and annealed at 500° C. for one hour. These samples were subjected to a tensile test and an electric conductivity measurement test after the annealing.

Figure 2:
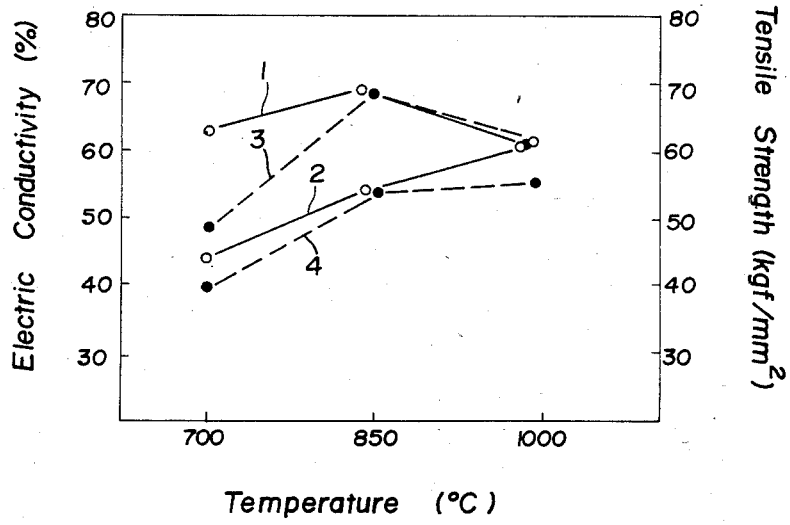
FIG. 2 is a graph which shows the relationship between the solution treatment temperature and the conductivity or tensile strength of each of the present invention alloys produced in the Examples.

In FIG. 2, the solution treatment temperature along the axis of ordinates were plotted against the tensile strength and conductivity along the axis of abscissas. In FIG. 2, curves 1 and 2 represent the conductivity and tensile strength of the alloys of this invention, respectively, and curves 3 and 4 are those of the comparative alloys. FIG. 2 shows that the alloys of this invention show smaller deterioration of properties than the comparative alloys when the solution treatment temperature was low. Further, the spring limit value of the alloy of this invention subjected to a solution treatment at 1000° C. was measured and found to be 49 kg/mm$^2$, which indicated excellent spring property.

EXAMPLE 3

Figure 3:
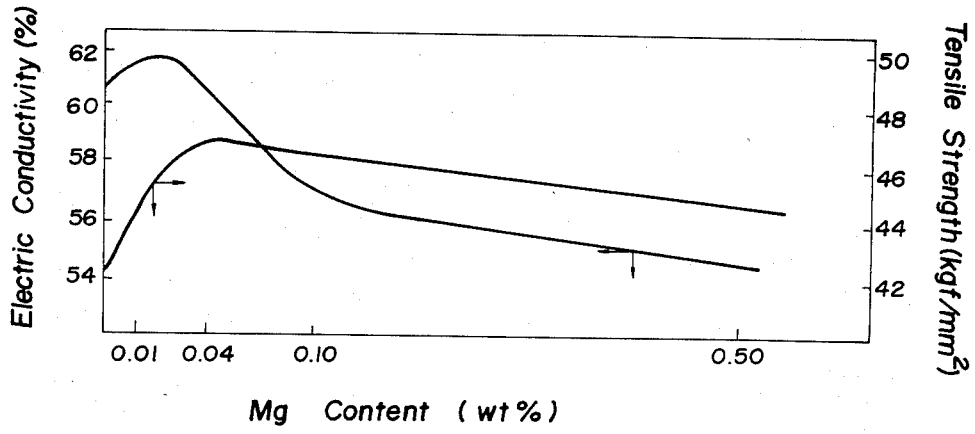
FIGS. 3 and 4 are graphs which show the effect of adding Mg or Ni to a Cu-Fe-Ti alloy.

Cu-0.35 Ti-0.67 Fe-Mg alloys having various Mg contents were formed and annealed at 500° C. for one hour in the same way as in Example 2 to measure the tensile strength and conductivity. The results are shown in FIG. 3.

EXAMPLE 4

Figure 4:
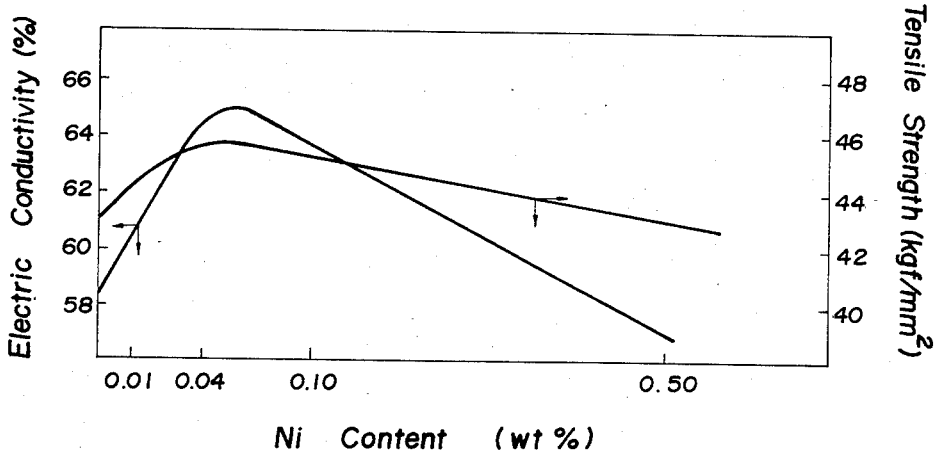

Cu-0.35 Ti-0.67 Fe-Ni alloys having various Ni contents were formed and annealed at 500° C. for one hour in the same way as in Example 2 to measure the tensile strength and conductivity. The results are shown in FIG. 4.

EXAMPLE 5

Figure 5:
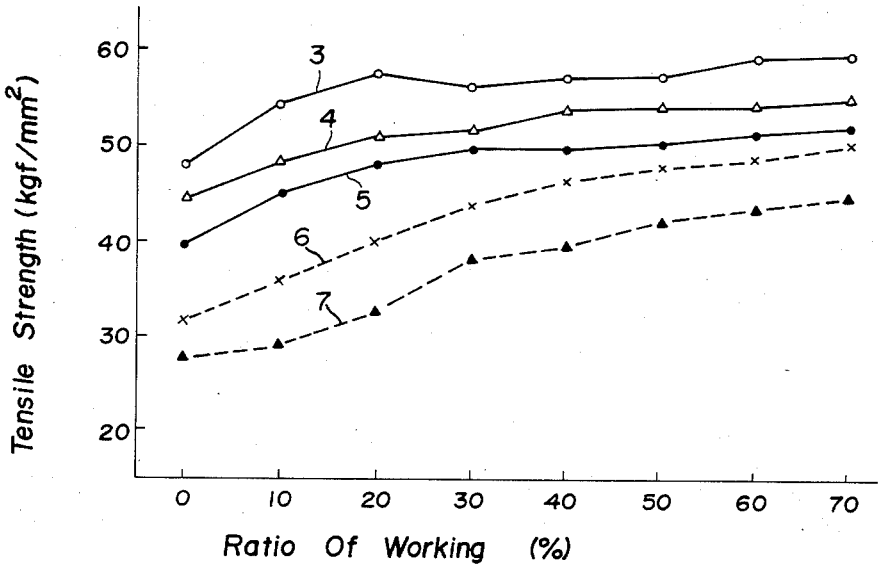
FIGS. 5 through 10 are graphs which whow the work hardening properties and softening properties of the present invention alloys and comparative alloys prepared in the following Examples.
Figure 6:
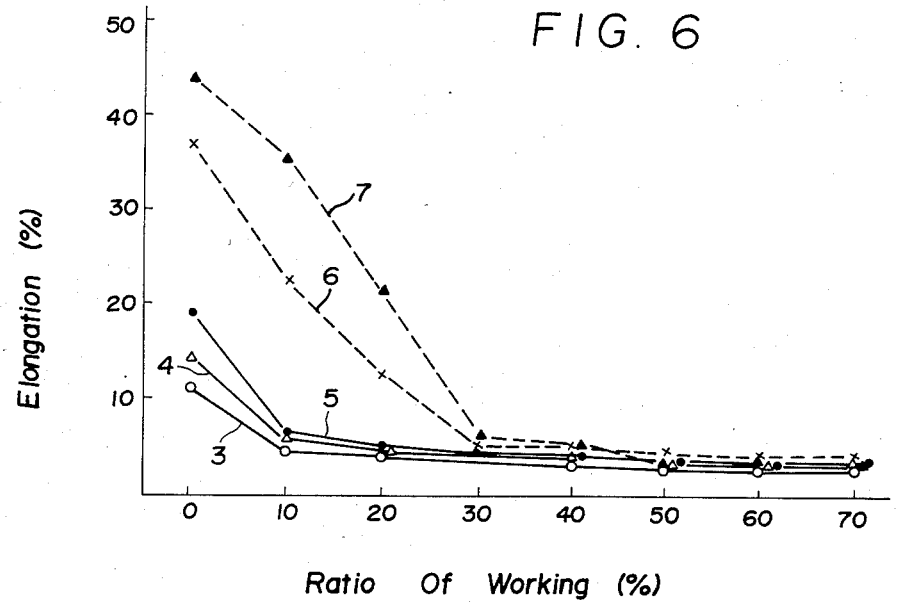

The work hardening characteristics were examined on 1.5 mm-thick sheets which were annealed at 500° C. for two hours and formed from a Cu-0.36 Ti-0.69 Fe-0.60 Mg (curve 3) and a 0.32 Ti-0.69 Fe-0.04 Ni (curve 4) as the alloys of this invention, and a Cu-0.31 Ti-0.70 Fe alloy (curve 5), a Cu-2.4 Fe-0.17 Zn-0.03 P alloy (curve 6), and a Cu-0.13 Fe-0.03 P alloy (curve 7) as comparative alloys. The tensile strengths and the elongations are shown in FIGS. 5 and 6, respectively. These figures show that the alloys of this invention show a slightly larger work hardening but had a maximum tensile strength of 60 kgf/mm$^2$, suggesting that they are high-strength alloys.

EXAMPLE 6

Figure 7:
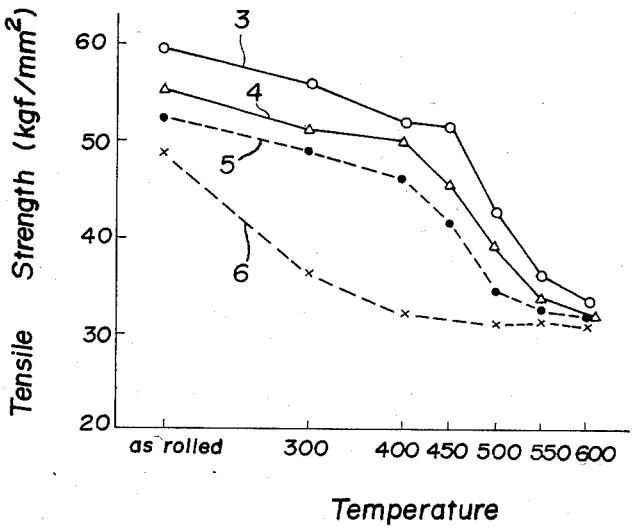
Figure 8:
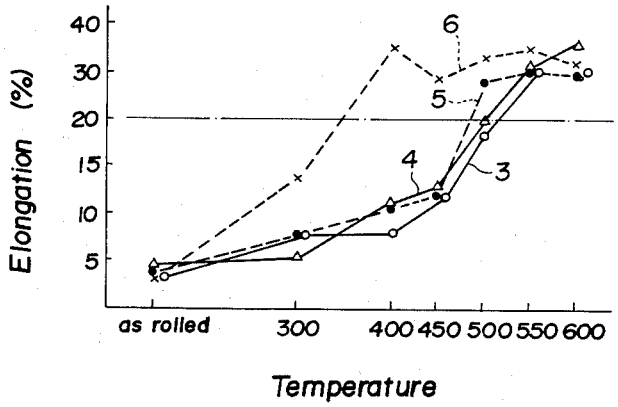
Figure 9:
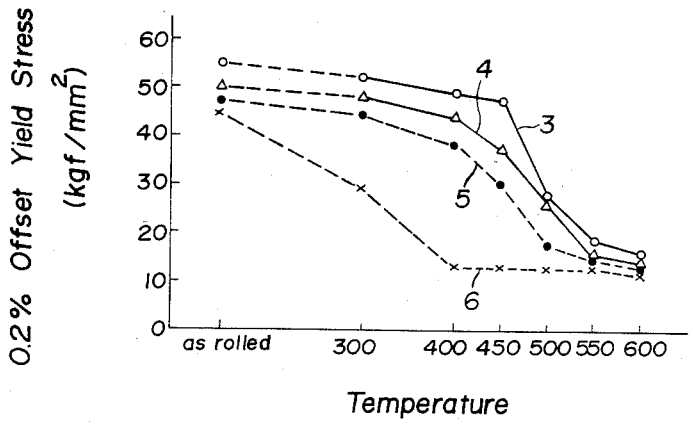

An ingot having the same composition as that in Example 5 was hot-rolled to a thickness of 5 mm, subjected to a solid solution treatment at 750° C. for 2 hours, cold-rolled to a thickness of 1.0 mm and then, after annealing at 500° C. for two hours, cold-rolled to a thickness of 0.5 mm. Samples prepared from this sheet were annealed for one hour at various temperatures to obtain anneling-softening curves (FIGS. 7 and 8), and an offset yield stress curve (FIG. 9). In these figures, the same samples as in FIGS. 5 and 6 are represented by the same symbols. These figures show that the heat resistance of the alloys of this invention is excellent. Their half-softening temperatures was 260° C. for CDA 194 alloy (Cu-Fe-Zn-P), 450° C. for Cu-Ti-Fe, 460° C. for Cu-Ti-Fe-Ni, and 480° C. for Cu-Ti-Mg.

EXAMPLE 7

Figure 10:
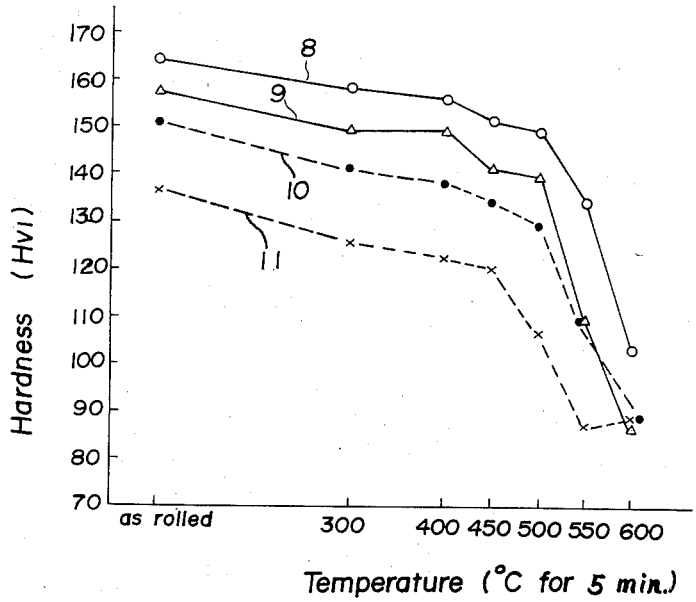

20% cold-worked materials prepared in the same way as in Example 6 from Cu-0.36 Ti-0.69 Fe-0.66 Mg (curve 8) and 0.32 Ti-0.69 Fe-0.04 Ni (curve 9) as the alloys of this invention and Cu-0.34 Ti-0.71 Fe (curve 10) and Cu-2.35 Fe-0.18 Zn-0.04 P (curve 11) as comparative alloys were held at various temperature for 5 minutes to obtain softening curves. The results are shown in FIG. 10. When a softening temperature was defined as a temperature at which the hardness was lowered to 80% of the initial hardness, the softening temperatures were 560° C. for Cu-Ti-Fe-Mg, 520° C. for Cu-Ti-Fe-Ni, 518° C. for Cu-Ti-Fe and 490° C. for CDA 194. It can be seen that the alloys of this invention had excellent softening properties like the alloys in Example 6.

As described above, the alloy of this invention not only has excellent softening properties and good strength and electric conductivity but also is free from any practical problem in bending strength, solderability, electroplatability (i.e. properties important for electroplating such as the adhesion of the deposited metal, and visual appearance) oxidation resistance, hydrogen embrittlement resistance, stress corrosion cracking resistance, and corrosion resistance, and can be put into industrial production without encountering any problem, and are suitable as well as extremely useful as materials for semiconductor lead frames, for electrical parts such as connector switches, springs, terminals, and clips, and for heat exchanger fins and for welding tips.

What is claimed is:

1. A high strength and high conductivity copper alloy comprising 0.05 to 1.0% by weight of Ti, 0.07 to 2.6% by weight of Fe, and one or more members selected from the group consisting of 0.005 to 0.5% by weight of Mg, 0.01 to 0.5% by weight of each of Sb, V, Misch metal, Zr, In, Zn, Sn and Ni, 0.005 to 0.2% by weight of Al and 0.005 to 0.07% by weight of P, and the balance of Cu and wherein the Fe/Ti ratio (by weight) is within the range of 1.7 to 2.3.

2. An alloy as defined in claim 1 wherein the amount of Mg added is within the range of 0.03 to 0.10% by weight.

3. An alloy as defined in claim 1 wherein the amount of Ni added is within the range of 0.01 to 0.07% by weight.

* * * * *

UNITED STATES PATENT AND TRADEMARK OFFICE

CERTIFICATE OF CORRECTION

PATENT NO. : 4,559,200

DATED : December 17, 1985

INVENTOR(S) : Syuichi Yamasaki, et al.

It is certified that error appears in the above-identified patent and that said Letters Patent is hereby corrected as shown below:

Column 5, Table 1, line 20, delete "46.7" and insert therefor --46.9--.

Column 6, Table 2 should read as follows:

TABLE 2

| | | Bending radii (mm) | | |
|---|---|---|---|---|
| No. | Alloy | 0 | 0.2 | 0.4 |
| 1 | alloy of this invention | ○ | ◎ | ◎ |
| 4 | alloy of this invention | ○ | ◎ | ◎ |
| 11 | alloy of this invention | ○ | ◎ | ◎ |
| 18 | comparative alloy | ○ | ◎ | ◎ |

○ small wrinkle
◎ good

Signed and Sealed this

Fifth Day of August 1986

[SEAL]

Attest:

DONALD J. QUIGG

Attesting Officer

Commissioner of Patents and Trademarks